United States Patent [19]

Tatsukawa et al.

[11] 4,131,779

[45] Dec. 26, 1978

[54] HIGH-FREQUENCY HEATING APPARATUS

[75] Inventors: Osami Tatsukawa, Matsudo; Osamu Sakurai, Ibaraki; Hisayuki Serizawa, Tsuchiura, all of Japan

[73] Assignee: Hitachi Heating Appliances Co., Ltd., Japan

[21] Appl. No.: 813,418

[22] Filed: Jul. 6, 1977

[30] Foreign Application Priority Data

| | | | |
|---|---|---|---|
| Jul. 7, 1976 | [JP] | Japan | 51-80627 |
| Jul. 21, 1976 | [JP] | Japan | 51-86884[U] |
| Jul. 21, 1976 | [JP] | Japan | 51-97038 |

[51] Int. Cl.[2] ..... H05B 9/06

[52] U.S. Cl. ..... 219/10.55 R; 126/193

[58] Field of Search ..... 219/10.55 R, 10.55 B, 219/10.55 D; 126/273 R, 198, 193

[56] References Cited

U.S. PATENT DOCUMENTS

| | | | |
|---|---|---|---|
| 3,470,942 | 10/1969 | Fukada et al. | 219/10.55 B |
| 3,681,557 | 8/1972 | Suzuki et al. | 219/10.55 D |
| 3,783,219 | 1/1974 | Tateda | 219/10.55 D |
| 4,028,520 | 6/1977 | Torrey | 219/10.55 B |

*Primary Examiner*—Arthur T. Grimley
*Attorney, Agent, or Firm*—Craig & Antonelli

[57] ABSTRACT

The present invention involves a high-frequency heating apparatus of the type which comprises a heating chamber for accommodating an object to be heated, a door openably and closably provided for an opening of the heating chamber, a high-frequency energy generator for supplying high-frequency energy to the interior of the heating chamber, a fan for forcibly ventilating the interior of the heating chamber, and a heating chamber air-outlet cooperative with the fan to effect the forcible ventilation for the interior of the heating chamber. Temperature of air flowing out of heating chamber through the heating chamber air-outlet is detected by a temperature sensor to actuate an automatic heating control unit for controlling the supply of high-frequency energy. The apparatus is also provided with a manual heating control unit for manually controlling the heating time. In response to a selective operation of one of the automatic heating control unit and the manual heating control unit, an air flow path changer is actuated to change a part of the flow path of the air for ventilating the interior of the heating chamber.

21 Claims, 7 Drawing Figures

HIGH-FREQUENCY HEATING APPARATUS

FIELD OF THE INVENTION

The present invention relates to a high-frequency heating apparatus and, in particular, it relates to the improvement of a high-frequency heating apparatus having an arrangement for automatically controlling the heating time by detecting temperature of an object to be heated.

PRIOR ART OF THE INVENTION

In the past, methods have been proposed which approach the detection of heating status of an object to be heated for the purpose of automatically heat-controlling the object to be heated with a high-frequency heating apparatus such as microwave oven and wherein the temperature of the object to be heated is indirectly detected by detecting temperature of air flowing out of the heating chamber air-outlet or temperature of air within the heating chamber, as disclosed in U.S. Pat. Nos. 3,185,809 and 3,281,568, for example.

Figure 1:
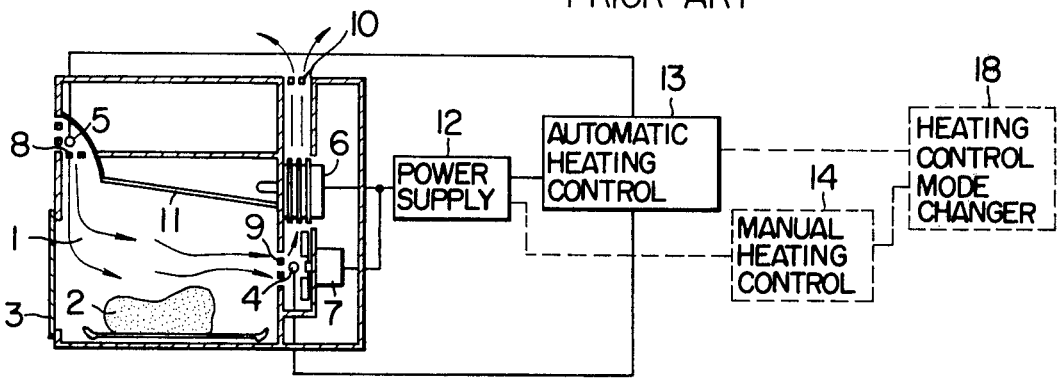
FIG. 1 PRIOR ART
FIG. 1 is a longitudinal sectional view of a prior art high-frequency heating apparatus for controlling the supply of high-frequency energy by detecting temperature of the air at the heating chamber air-inlet and -outlet.

Referring to FIG. 1, there is shown an example of a high-frequency heating apparatus of the type mentioned above. In the figure, arrows represent air flow directions.

Figure 2:
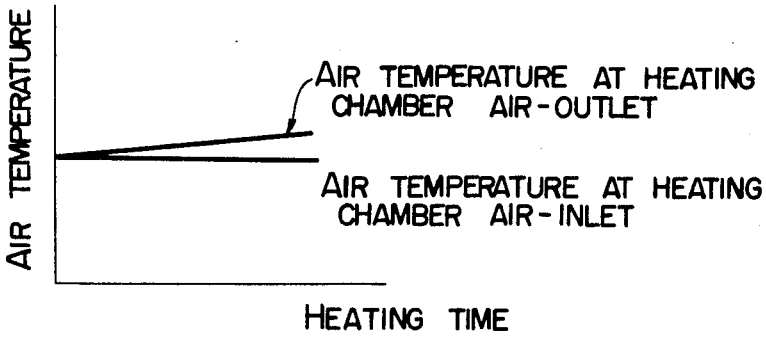
FIG. 2 is a graphic representation showing temperature rise characteristics of heating chamber inlet air and outlet air obtainable with the apparatus of FIG. 1.

An object 2 to be heated is placed in a heating chamber 1 and then a door 3 openably and closably supported at an entrance opening of the heating chamber 1 is shut. When shut, the door 3 acts to seal high-frequency energy within the heating chamber 1. When a power unit 12 is turned on, a high-frequency energy generator 6 begins oscillating so as to supply high frequency energy to the heating chamber 1 through a partition plate 11 made of a low high-frequency loss material so that the object 2 is heated. A fan 7 is also operated to draw atmospheric air into the heating chamber 1 from a heating chamber air inlet 8. The air thus drawn into the heating chamber is passed around the object 2, mixed with aqueous vapor given off by the object 2 to be heated, discharged from the heating chamber 1 through a heating chamber air outlet 9, passed through the fan 7 and the high-frequency energy generator 6 while cooling the latter, and finally discharged from an apparatus air-outlet 10. In the course of this air flow, when the temperature of atmospheric air drawn into the heating chamber 1 and that of air flow discharged from the heating chamber 1 are respectively detected by an inlet temperature sensor 5 and an outlet temperature sensor 4 respectively disposed at the heating chamber air inlet 8 and the heating chamber air-outlet 9 as shown in FIG. 1, a result as shown in FIG. 2 is obtained wherein the air temperature at the heating chamber air-inlet 8 (say, temperature of atmospheric air) remains substantially unchanged with the heating time whereas the air temperature at the heating chamber air-outlet 9 increases gradually.

Figure 3:
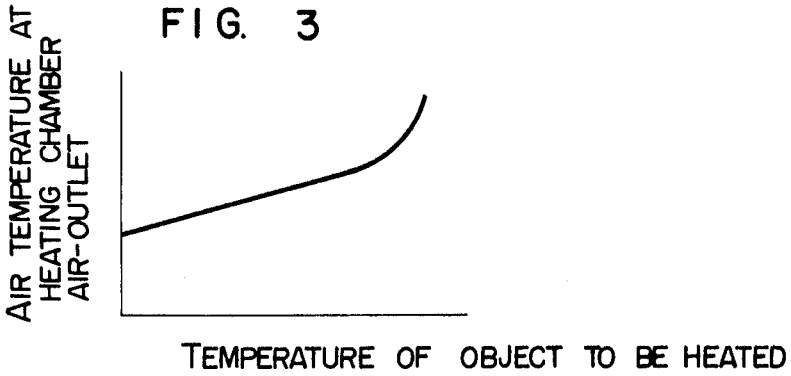
FIG. 3 is a graphic representation showing the relation between temperature rise in the object to be heated and temperature rise in the heating chamber outlet air which is measured by a heating chamber outlet air temperature sensor, this relation being obtainable with the apparatus shown in FIG. 1.

The gradual increase in the air temperature at the heating chamber air-outlet 9 results from the fact that as the object 2 becomes heated by the high-frequency energy fed from the high-frequency energy generator 6, it in turn heats the air within the heating chamber 1. FIG. 3 proves this, illustrating the relation between the temperature of the object 2 to be heated by the high-frequency energy fed from the high-frequency energy generator 6 and the temperature of air discharged from the air-outlet 9 of the heating chamber 1. As will be seen from FIG. 3, for a relatively low temperature range of the object 2, the temperature of the object 2 is approximately proportioned to the air temperature at the heating chamber air-outlet 9 but in the proximity of a saturation temperature of the object 2, the outlet air temperature increases abruptly. Thus, by detecting a temperature rise in the outlet air during heating (approximately equal to a temperature difference between inlet air and outlet air) in consideration of the above characteristics, it is possible to detect the heating status of the object 2. When a detecting signal representative of the heating status of the object reaches a predetermined value, an automatic heating control unit 13 controls the operation of the power unit 12 which in turn controls the oscillation of the high-frequency energy generator 6, thereby automatically controlling the heating time.

However, in some applications, for example, in the case of cooking raw foodstuffs such as fish, the continuation of heating is necessary until the object 2 to be heated is sufficiently coocked, following the termination of a preset temperature for this object. To this end, it is usual to provide the high-frequency heating apparatus, in addition to the automatic heating control unit 13, with a manual heating control unit 14 such as a timer and a heating control mode changer 18. In the automatic heating control mode using the automatic heating control unit 13, no attendant problem will be caused since the high-frequency energy generator 6 stops oscillating automatically when temperature of the object 2 reaches a preset value. But, in the case of heating control being changed to the manual heating control mode for cooking raw foodstuffs, for example, the continuation of heating is necessary for this object since a large amount of aqueous vapor is given off by the object 2 with the result that the wall surface of heating chamber 1 is dewed, causing water drops to deposit on the wall surface and in extremity, flooding the interior of heating chamber. Especially, with a high-frequency heating apparatus having a door 3 formed with a peep or inspection window which is made of a transparent material but can prevent high-frequency energy from leaking therethrough, the window becomes dimmed with dew of aqueous vapor, preventing the heating status of an object 2 from being viewed. Even if fresh atmospheric air or external air is blown against the interior of the heating chamber 1 and the window of door 3 as shown in FIG. 1, this problem cannot be solved by the utilization of direct external air having a relatively low temperature. Furthermore, the prior art apparatus as shown in FIG. 1 has difficulties with having the above defect removed by introducing into the heating chamber heated air which has been passed through any heat generating components, such as the high-frequency energy generator or other electrical components, for the purpose of cooling them without imparing accuracies of the air temperature detection. In detail, the high-frequency energy generator 6 oscillates with the attendant generation of heat and temperature in the high-frequency energy generator 6 will rise with time which has lapsed since initiation of the oscillation. This temperature rise is irregular which depends on initial temperature of the oscillating high-frequency energy generator 6 and the kind and mass of the object 2 to be heated. With the introduction of such a heated air as being varying with time and having irregular temperature rise into the heating chamber 1, the temperature rise in the heating chamber outlet air due to the heating of the object 2 would be indistinctive from that due to the heated air such as originating from cooling air for the high-frequency energy generator 6. Consequently, in the automatic heating control mode, detecting accuracy of the heating status of the object would be degraded, resulting in inaccurate heat controlling.

SUMMARY OF THE INVENTION

It is a principal object of this invention to provide an improved high-frequency heating apparatus of the type comprising the automatic heating control unit and the manual heating control unit in combination capable of changing the heating control mode, the improvement obviating the above prior art disadvantages and preventing the creation of dew on the wall surface of heating chamber and the peep or inspection window of the door, thereby permitting pleasant usage of the apparatus.

According to this invention, the above object can be accomplished by providing an improved high-frequency heating apparatus of the type comprising the automatic heating control unit and the manual heating control unit in combination wherein the heating treatment can be effected in selected one of the heating control modes, the improvement wherein a part of the flow path of air for ventilating the interior of the heating chamber is changed so that, if desired, heated air which has been subjected to temperature rise by cooling a heat generating component disposed exteriorly of the heating chamber can be charged into the heating chamber.

Other objects, features and effects will be understood more fully from the following description by referring to the accompanying drawings.

PREFERRED EMBODIMENTS OF THE INVENTION

The invention will now be described by way of embodiments with reference to the drawings. The same reference numerals as in FIG. 1 are used in other figures for designating like components, of which detailed descriptions will sometimes be omitted.

Figure 4:
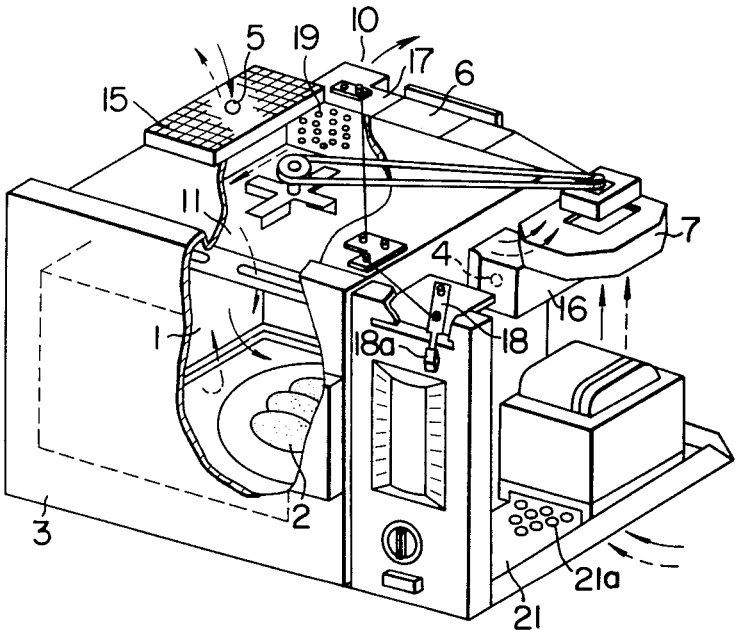
FIG. 4 is a perspective view of one embodiment of the invention.
Figure 5:
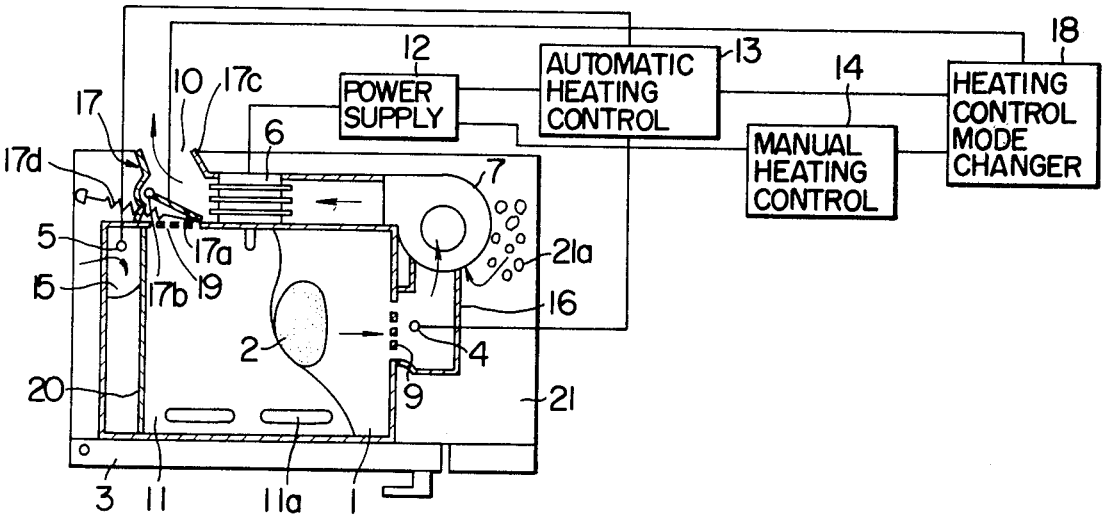
FIG. 5 is a cross-sectional view of the apparatus of FIG. 4 wherein the apparatus is being operated in the mode of an automatic heating control.
Figure 6:
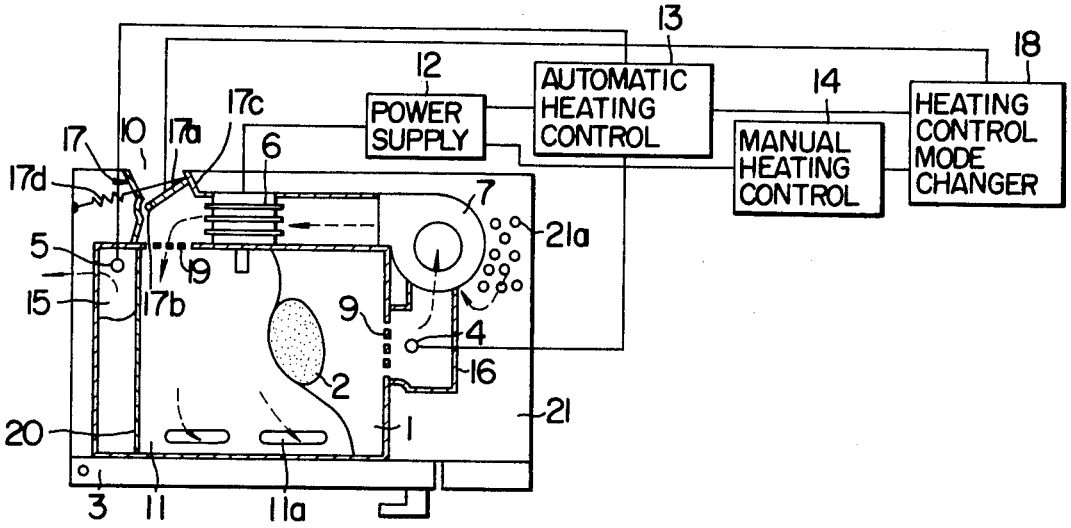
FIG. 6 is a cross-sectional view of the apparatus of FIG. 4 wherein the apparatus is being operated in the mode of a manual heating control.

Referring to FIGS. 4, 5 and 6, there is shown a high-frequency heating apparatus embodying the invention. The apparatus comprises as shown in FIG. 4 an air flow path changer 17, a heating chamber air inlet/outlet 15, and a heating control mode changer 18 externally operable in cooperative with the air flow path changer 17. The air flow path changer 17 comprises as shown in FIGS. 5 and 6 an apparatus air-outlet-duct 17*c*, a damper 17*a* swingably supported by a shaft 17*b* disposed in the duct 17*c*, and a spring 17*d* urging the damper 17*a* against either one position at which the duct 17*c* is opened or the other position at which the duct 17*c* is closed. FIG. 5, which is a cross-sectional view of FIG. 4, shows the above-mentioned one position of the damper 17*a* when an automatic heating control unit 13 is operated with a heating control mode changer 18 changed to the automatic heating control molde. FIG. 6, which is also a cross-sectional view of FIG. 4, shows the other position of the damper 17*a* when a manual heating control unit 14 is operated with the heating control mode changer 18 changed to the manual heating control mode. In FIGS. 4, 5 and 6, arrows indicate air flow directions, solid line arrows indicating air flow directions for the automatic heating control mode and dotted line arrows indicating those for the manual heating control mode.

Turning to FIGS. 4 and 5, an object 2 to be heated is placed in a heating chamber 1 and heated by high-frequency energy fed from a high-frequency energy generator 6. During heating, a fan 7 is operated and in the automatic heating control mode using the automatic heating control unit 13, atmospheric air drawn into the heating chamber 1 through a heating chamber air inlet/-outlet 15 is passed around the object 2, drawn out of the heating chamber 1 through a heating chamber air-outlet 9, and passed through a heating chamber outlet-duct 16 and the fan 7 to cool the high-frequency energy generator 6. The air subjected to a heat exchange by cooling the high-frequency energy generator 6 and undergoing a temperature rise is directed to the apparatus air-outlet-duct 17*c* and driven out of the high-frequency heating apparatus through an apparatus air-outlet 10. On the other hand, atmospheric air drawn into an electrical equipments chamber 21 through an electrical equipments chamber air-inlet 21*a* consisting of a plurality of perforations formed in the bottom of a housing of the high-frequency heating apparatus is sucked into the fan 7 while cooling electrical component parts in the electrical equipments chamber, mixed with the air drawn out of the heating chamber to pass through the high-frequency energy generator 6, and finally driven out of the high-frequency heating apparatus through the apparatus air-outlet 10, as shown at solid line arrows. In this mode, one end of the damper 17*a* of air flow path changer, as shown in FIG. 5, is urged against the wall of the heating chamber to thereby open the duct 17*c*. Thus, when the temperature of air to be drawn into the heating chamber 1 is detected by a heating chamber inlet temperature sensor 5 and the temperature of air drawn out of the heating chamber 1 is detected by a heating chamber outlet temperature sensor 4, it is possible to indirectly measure or estimate the temperature of the object 2 by using the difference between the two detected values, as described hereinbefore. Actually, detected signals from the temperature sensors 4 and 5 are fed to the automatic heating control unit 13 and when a temperature rise in the outlet air in detail a difference between the two detected values, reaches a preset value, the automatic heating control unit 13 causes a power unit 12 to be controlled in such a manner that the high-frequency energy generator 6 stops oscillating, thereby completing the heating operation.

Turning to FIG. 6 the air flow path in the case of the manual heating control mode using the manual heating control unit 14 such as timer will be described. In this mode, the air flow path changer 17 is manipulated such that the damper 17*a* positioned as shown in FIG. 5 is transfered to a position shown in FIG. 6 and in addition, the heating control mode changer 18 is manipulated such that the automatic heating control unit 13 is disconnected and the manual heating control unit 14 is brought into connection. At this time, the damper 17 is transferred to the position to block the duct 17*c* and urged against this position by the spring 17*d*. Even with the control mode changed to the manual heating controlling, the fan 7 rotates in the same direction as in the automatic heating control mode during heating so that atmospheric air drawn into the electrical equipments chamber 21 through the electrical equipments chamber air-inlet 21*a* is passed through the fan 7 while cooling electrical component parts disposed in the electrical equipments chamber 21 and directed to the high-frequency energy generator 6 to cool it. However, in the manual heating control mode, this air flow undergoing a temperature rise is then directed through a heating chamber air intake 19 to a space above a partition plate 11 supported in the heating chamber 1 since the duct 17*c* is blocked by the damper 17*a* of the air flow path changer 17. Thereafter, this air flow is passed along an air flow guide 20, jetted out of a partition plate opening 11*a* to blow a peep or inspection window of the door 3 so as to prevent creation of dew drops thereon, passed around the object 2, and finally driven out of the high-frequency heating apparatus through the heating chamber air-inlet/outlet 15. It should be noted that, in the manual heating control mode, atmospheric air is drawn into the apparatus only through the electrical equipments chamber air inlet 21*a* but not through the heating chamber air-inlet/outlet.

Preferably, as shown in FIGS. 5 and 6, the damper 17*a* of the air flow path changer 17 is designed to swing about the shaft 17*b* opposing the high-frequency energy generator 6 and the walls of the duct 17*c* and the heating chamber 1 with which the damper is brought into contact are provided with a flexible packing (not shown) for the purpose of preventing leakage of air flow.

The invention has been described hereinbefore by referring to an arrangement comprising both the automatic heating control unit 13 for automatically controlling the heating time of the object 2 to be heated and the manual heating control unit 14 for manually controlling the heating time by providing a timer or the like. As will be seen from FIGS. 5 and 6, the invention is featured by the provision of the air flow path changer 17 comprising the apparatus air-outlet-duct 17*c* and the damper 17*a* swingably supported therein, whereby in the automatic heating control mode using the automatic heating control unit 13, on one hand, the heated air following cooling of the high-frequency energy generator 6 will not driven into the heating chamber so that there is no fear that the accuracy of detecting temperature rise in the heating chamber outlet air is degraded and in the manual heating control mode using the manual heating control unit 14, on the other hand, the heated air following cooling of the high-frequency energy generator 6 is driven into the heating chamber 1 to blow the peep or inspection window of the door 3 and passed through the interior of the heating chamber so that the continuation of heating of the object 2 under the generation of a large amount of aqueous vapor therefrom never causes the peep or inspection window of the door 3 to be dimmed with dew drops, thereby preventing flooding the heating chamber 1. The heating control mode changer 18 and air flow path changer 17 may be operated manually and independently but preferably both of them are interlocked since the change from automatic heating control mode to manual heating control mode or vice versa can easily be achieved. When interlocked, it is sufficient to manually operate at least one of the heating control mode changer 18 and air flow path changer 17. In FIGS. 4, 5 and 6, the changers 17 and 18 are operated simultaneously by manipulating a handle 18*a*.

The opening of duct 17*c* can take any form of cross-section but a square or rectangular cross-section is preferred. The damper 17*a* has a structure termed "a butterfly damper" having one end connected to the shaft 17*b* to swing thereabout and therefore it is simple, economical and reliable.

Prior to this embodiment, an approach has been made to the air flow path changer wherein two blades are slidably supported on the respective wall portions encompassing the heating chamber air intake 19 and the outlet 10 of the duct 17*c* such that these intake 19 and outlet 10 may alternatively be opened. This approach, however, was sophisticated in construction and its operation locked smoothness and reliability. It will be appreciated that a friction between the damper 17*a* and the shaft 17*b* when the damper 17*a* swings is far smaller than a friction caused by sliding the damper blade.

Figure 7:
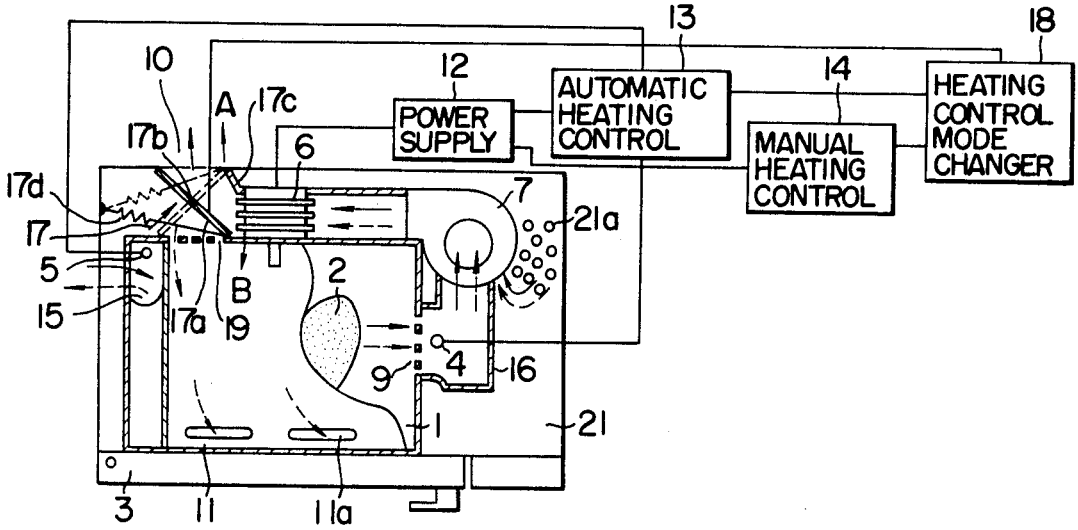
FIG. 7 is a cross-sectional view of another embodiment of the invention.

FIG. 7 shows another embodiment of this invention which is the same as the preceding embodiment shown in FIGS. 4, 5 and 6 except a damper structure so that descriptions of charging air into the apparatus, circulating the air and discharging the air from the apparatus will be omitted herein. A damper of this embodiment also takes the form of the butterfly damper structure but a shaft 17*b* about which a damper 17*a* swings is disposed across substantially the intermediate portion of the blade of the damper 17*a* and the damper 17*a* swings about this shaft 17*b* in a seesaw fashion. Accordingly, in this embodiment, the damper blade may be formed into a square or rectangular configuration. It may also be of a circular configuration in accordance with the cross-section of the duct 17*c*. In short, it is of essential matter that the air flow path can be changed completely for the desired purposes.

As having described with reference to foregoing embodiments, in the automatic heating conrol mode, when the temperature rise in outlet air reaches a preset value, the high-frequency energy generator 7 stops oscillating. Alternatively, the invention may obviously be applicable such that when the temperature rise in outlet air reaches the preset value, the amount of high-frequency energy supply is controlled decreasingly so as to continue the heating under the application of the decreased energy.

Furthermore, instead of non-ventilative door 3 as in the foregoing embodiments, the door may be formed with an opening which acts as the heating chamber air inlet/outlet.

Furthermore, the fan 7 has been placed upstream relative to the high-frequency energy generator 6 to feed air thereto but inversely, the fan 7 may be placed downstream relative to the high-frequency energy generator 6 to suck air therefrom to thereby pass the air to the apparatus air-outlet 10 or air intake 19.

As has been described in detail, according to the invention, the bufferfly damper is provided at a part of the air flow path and it prevents the heated air following cooling of the high-frequency energy generator 6 from being driven into the heating chamber in the automatic heating control mode, whereby the object 2 can be heated properly without degrading the accuracy of detecting temperature rise in air flow. In the manual heating control mode using a timer for manually setting the heating time, the heated air following cooling of the high-frequency energy generator is driven into the heating chamber, whereby the peep or inspection window of the door can be prevented from being dimmed so that good visibility to the heating status of the object to be heated can be assured. In this manner, it is possible to properly exchange the automatic heating control mode with the manual heating control mode or vice versa in a single high-frequency heating apparatus.

We claim:

1. A high-frequency heating apparatus comprising:

a housing;

a heating chamber formed in said housing for accommodating an object to be heated, said heating chamber being defined by walls which surround said heating chamber and are formed with a first opening for taking in and out the object;

a door supported by said housing openably and closably and sealing said first opening against high-frequency energy when closed;

means for generating high-frequency energy to feed it into said heating chamber;

means connected to said high-frequency energy generating and feeding means to control the generation of the high-frequency energy and the amount of supply of the same;

first heating time controlling means including means for detecting temperature of the object which is accommodated in said heating chamber and is being heated and actuating said high frequency energy supply controlling means when a detected signal of temperature reaches a predetermined value whereby the heating time is automatically controlled;

second heating time controlling means for manually controlling the heating time by actuating the high-frequency energy supply controlling means;

heating control mode changing means for selectively actuating one of said first and second heating time controlling means;

means for generating heat disposed inside said housing but outside said heating chamber;

a first ventilating path for ventilating said heating chamber including at one end a second opening provided at a part of at least one of said door and said housing, at the other end a third opening provided at a part of said housing and communicating with said second opening, and a space of said heating chamber between said second and third openings, said heat generating means being disposed at a part of said first ventilating path;

a second ventilating path for ventilating said heating chamber including at one end a fourth opening provided at a part of said housing, at the other end said second opening communicating with said fourth opening, and the space of said heating chamber between said second and fourth openings, said heat generating means being disposed at a part of said second ventilating path;

means for forcibly flowing air along selected one of said first and second ventilating paths; and ventilating path changing means for selecting one of said first and second ventilating paths such that when said first ventilating path is selected by said changing means, atmospheric air is drawn by said air forcibly circulating means from said second opening, passed through said heating chamber and then through said heat generating means and driven out of said third opening and when said second ventilating path is selected, atmospheric air is drawn by said air forcibly circulating means, passed through said heat generating means and then through said heating chamber and driven out of said second opening.

2. The apparatus according to claim 1, wherein said high-frequency energy generating and feeding means includes a high-frequency oscillator and said heat generating means includes said high-frequency oscillator.

3. The apparatus according to claim 1, wherein a fifth opening is provided at a part of said walls defining said heating chamber, and said first ventilating path is established through said fifth opening, whereby when said first ventilating path is selected by said ventilating path changing means, the air in said heating chamber is drawn out of said fifth opening.

4. The apparatus according to claim 2, wherein said object temperature detecting means comprises first and second temperature sensors respectively disposed at said second and fifth openings, whereby said object temperature detecting means delivers a detecting signal representative a difference between the detected values of said first and second temperature sensors, corresponding to the temperature of the object to be heated.

5. The apparatus according to claim 1, wherein a path from said fourth opening to said third opening also establishes a part of said first ventilating path when said first ventilating path is selected by said ventilating path changing means, whereby atmospheric air is also drawn through said fourth opening, passed through said heat generating means and then driven out of said third opening.

6. The apparatus according to claim 3, wherein a path from said fourth opening to said third opening also establishes a part of said first ventilating path when said first ventilating path is selected by said ventilating path changing means, whereby atmospheric air is also drawn through said fourth opening, passed through said heat generating means and then driven out of said third opening.

7. The apparatus according to claim 6, wherein a sixth opening is provided at a part of said walls defining said heating chamber, and said second ventilating path is established through said sixth opening, whereby when said second ventilating path is selected by said ventilating path changing means, atmospheric air drawn through said fourth opening and passed through said heat generating means is induced into said heating chamber through said sixth opening and then driven out of said second opening.

8. The apparatus according to claim 7, wherein said door is provided with a transparent window for viewing the interior of said heating chamber, whereby when said second ventilating path is selected by said ventilating path changing means, the air flow driven out of said sixth opening is passed near said window.

9. The apparatus according to claim 6, wherein said ventilating path changing means comprises a butterfly damper which is disposed in a path communicating said third opening with said sixth opening, whereby the change of ventilating path is effected such that said sixth opening is closed with said butterfly damper when said first ventilating path is selected and said third opening is closed with said butterfly damper when said second ventilating path is selected.

10. The apparatus according to claim 9, wherein said door is provided with a transparent window for viewing the interior of said heating chamber, whereby when said second ventilating path is selected by said ventilating path changing means, the air flow driven out of said sixth opening is passed near said window.

11. The apparatus according to claim 1, wherein said heating control mode changing means is interlocked with said ventilating path changing means, whereby when said first heating time controlling means is selected by said heating control mode changing means, said first ventilating path is selected simultaneously and when said second heating time controlling means is selected, said second ventilating path is selected simultaneously.

12. The apparatus according to claim 3, wherein said heating control mode changing means is interlocked with said ventilating path changing means, whereby when said first heating time controlling means is selected by said heating control mode changing means, said first ventilating path is selected simultaneously and when said second heating time controlling means is selected, said second ventilating path is selected simultaneously.

13. The apparatus according to claim 4, wherein said heating control mode changing means is interlocked with said ventilating path changing means, whereby when said first heating time controlling means is selected by said heating control mode changing means, said first ventilating path is selected simultaneously and when said second heating time controlling means is selected, said second ventilating path is selected simultaneously.

14. The apparatus according to claim 5, wherein said heating control mode changing means is interlocked with said ventilating path changing means, whereby when said first heating time controlling means is selected by said heating control mode changing means, said first ventilating path is selected simultaneously and when said second heating time controlling means is selected, said second ventilating path is selected simultaneously.

15. The apparatus according to claim 6, wherein said heating control mode changing means is interlocked with said ventilating path changing means, whereby when said first heating time controlling means is selected by said heating control mode changing means, said first ventilating path is selected simultaneously and when said second heating time controlling means is selected, said second ventilating path is selected simultaneously 16. The apparatus according to claim 7, wherein said heating control mode changing means is interlocked with said ventilating path changing means, whereby when said first heating time controlling means is selected by said heating control mode changing means, said first ventilating path is selected simultaneously and when said second heating time controlling means is selected, said second ventilating path is selected simultaneously.

17. The apparatus according to claim 8, wherein said heating control mode changing means is interlocked with said ventilating path changing means, whereby when said first heating time controlling means is selected by said heating control mode changing means, said first ventilating path is selected simultaneously and when said second heating time controlling means is selected, said second ventilating path is selected simultaneously.

18. The apparatus according to claim 9, wherein said heating control mode changing means is interlocked with said ventilating path changing means, whereby when said first heating time controlling means is selected by said heating control mode changing means, said first ventilating path is selected simultaneously and when said second heating time controlling means is selected, said second ventilating path is selected simultaneously.

19. The apparatus according to claim 10, wherein said heating control mode changing means is interlocked with said ventilating path changing means, whereby when said first heating time controlling means is selected by said heating control mode changing means, said first ventilating path is selected simultaneously and when said second heating time controlling means is selected, said second ventilating path is selected simultaneously.

20. The apparatus according to claim 1, wherein said means for forcibly flowing air comprises an electric fan.

21. The apparatus according to claim 1, wherein said manual heating time controlling means comprises a timer.

* * * * *

UNITED STATES PATENT OFFICE

CERTIFICATE OF CORRECTION

Patent No. 4,131,779 Dated December 26, 1978

Inventor(s) Osami Tatsukawa et al.

It is certified that error appears in the above-identified patent and that said Letters Patent are hereby corrected as shown below:

In the Title Page

[30] Foreign Application Priority Data

Jul. 21, 1976 [JP] Japan ..... change "51-86884[U]" to --51-86884--

Jul. 21, 1976[JP] Japan ..... change "51-97038" to --51-97038[U]--

Signed and Sealed this

*Eighteenth* Day of *December 1979*

[SEAL]

*Attest:*

SIDNEY A. DIAMOND

*Attesting Officer*

*Commissioner of Patents and Trademarks*